US006648177B2

(12) United States Patent
Burger

(10) Patent No.: US 6,648,177 B2
(45) Date of Patent: Nov. 18, 2003

(54) MOBILE OIL DISPENSER

(75) Inventor: Adriano Burger, Mount Arlington, NJ (US)

(73) Assignee: Castrol Limited, Swindon (GB)

( * ) Notice: Subject to any disclaimer, the term of this patent is extended or adjusted under 35 U.S.C. 154(b) by 0 days.

(21) Appl. No.: 10/028,166

(22) Filed: Oct. 25, 2001

(65) Prior Publication Data

US 2003/0080161 A1 May 1, 2003

(51) Int. Cl.[7] ..... B67D 1/16

(52) U.S. Cl. ..... 222/108; 222/610; 222/626; 222/192; 222/383.3; 222/399

(58) Field of Search ..... 222/108, 608, 222/609, 610, 626, 192, 383.3, 399

(56) References Cited

U.S. PATENT DOCUMENTS

| | | | | | |
|---|---|---|---|---|---|
| 2,745,700 | A | * | 5/1956 | Phalen | 222/609 |
| 3,305,137 | A | * | 2/1967 | Gauthier et al. | 222/136 |
| 3,797,743 | A | | 3/1974 | Kommers et al. | 239/148 |
| 3,858,761 | A | * | 1/1975 | O'Dell | 222/626 |
| 3,940,065 | A | * | 2/1976 | Ware et al. | 239/146 |
| 4,089,446 | A | * | 5/1978 | Logan et al. | 222/609 |
| 5,139,278 | A | | 8/1992 | Vlasicak | 280/47.26 |
| 5,154,317 | A | | 10/1992 | Roppolo, III | 222/66 |
| D365,583 | S | | 12/1995 | Viken | D15/151 |
| 5,494,191 | A | | 2/1996 | Benson | 222/23 |
| 5,535,926 | A | * | 7/1996 | Blitz et al. | 222/334 |
| 5,667,113 | A | | 9/1997 | Clarke et al. | 222/608 |
| D394,499 | S | | 5/1998 | Bettag et al. | D23/332 |
| 5,810,213 | A | | 9/1998 | Flores et al. | 222/610 |
| 5,878,925 | A | * | 3/1999 | Denkins et al. | 222/608 |
| 6,325,251 | B1 | * | 12/2001 | Santos | 222/192 |

OTHER PUBLICATIONS

Page from Castrol Brochure "Castrol" The Liquid Engineer, 1 page, UK (1985).

* cited by examiner

*Primary Examiner*—Joseph A. Kaufman
(74) *Attorney, Agent, or Firm*—Jennifer M. Hall

(57) ABSTRACT

A mobile fluid dispenser is provided for dispensing fluids. The mobile fluid dispenser comprises a body defining a tank, a pump mounted to the body, and wheels mounted to the body. The body comprises a tank. The wheels are configured such that the mobile fluid dispenser can be rolled on flat surfaces without being tipped from an upright position. The pump may be either electrically powered or air powered, and may be reversible to allow the tank to be filled with fluid from a remote supply source. The tank may also be filled through a fill opening formed in the body or through quick coupler.

19 Claims, 6 Drawing Sheets

3/6

64
67
66
54
58
62
56
82
72
16
88
76
50
78
90
73
86
100
98
52
96
104
80
68
24
28
40
20
84
46
32
14
42
26
30
18, 34
30
18, 36
38
22
18, 34

MOBILE OIL DISPENSER

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Mobile fluid dispensers are used to provide a portable source of fluids to be supplied at different locations. One application where a mobile dispenser would be useful is that of an automotive maintenance shop, where the dispenser could be used to supply lubricant to different vehicles. Mobile fluid dispensing systems known in the art, however, suffer various drawbacks rendering them undesirable in many applications.

For example, some mobile fluid dispensers currently known consist of a tank, such as a 55 gallon drum, placed on a cart or a dolly. In use, a full tank of fluid is loaded onto the cart and secured to the cart by means of a belt or chain. A pump is inserted through an opening in the top of the tank to pump fluid from the tank. When the tank is empty, it must be removed from the cart and replaced with another tank of fluid. Designs of this type have several drawbacks. First, the process of replacing the tank is time consuming and cumbersome. The operator is required to remove and replace the chains or belts that are used to hold the tank in place. Loading and unloading a tank from a dolly can be particularly difficult when large tanks, such as 55 gallon drums, are used. Further, if the tank is not correctly placed on the cart, it may be unstable, resulting in a potentially unsafe condition. In addition, removing and replacing the pump is a very messy process because it will be covered with oil when it is removed from the empty tank.

Another problem with currently known dispensers is that they are difficult to maneuver. Known designs typically feature two wheels and a skid, rib, or base on which they rest. As a result, the dispensers must be tipped so that the skid, rib, or base clears the floor, and then moved while in an unstable tipped position. Tipping and moving the dispensers while they are tipped requires increased effort and results in increased inconvenience to the operator. Increased tank size and weight further exacerbate this problem.

BRIEF SUMMARY OF THE INVENTION

According to certain aspects of an embodiment of the present invention, a mobile fluid dispenser includes a body defining a reservoir for containing a fluid. A pump is mounted on the body and is adapted to pump fluid from the reservoir. A plurality of wheels are connected to the body such that the body can be rolled across a flat surface without tipping the body.

The body may include an upper portion defining the fluid reservoir and base connected to and supporting the upper portion and to which the wheels are connected. The upper portion is formed from a polymeric material, such as polyethylene plastic, and the lower portion may be formed at least in part of metal.

The mobile fluid dispenser may include a hose for fluid delivery. The hose has a first end connected to the pump for receiving fluid output by the pump and a second end connected to a nozzle which is adapted to meter fluid flow through the hose.

The mobile fluid dispenser may include a tool tray adapted to receive and support the nozzle. The tool tray includes a catch basin adapted to catch and retain fluid that leaks from the nozzle when the nozzle is positioned on the tool tray. The tool tray overlies the reservoir and the pump, and can be removed to provide access to the pump and the reservoir.

The pump may be either an electrically powered pump or a pneumatic pump. When the pump is electrically powered, the dispenser may include a power cord having a first end interconnected with the pump for delivering electricity thereto and a second end interconnected with an electric plug. The cord may be carried by a cord reel mounted on the dispenser so that the power cord is retractable onto the cord reel when not in use and is extendable from the cord reel so the plug can be interconnected with an external source of electric power.

The fluid reservoir may include a fluid fill opening configured to allow the reservoir to be filled with fluid from a remote source. A cap is removably mountable over said fluid fill opening. Alternatively, or in addition, the pump may be a reversible pump configured to pump fluid into the reservoir from a remote supply source.

The mobile fluid dispenser includes a pump mounting area. The pump mounting area may be configured so that the pump may be selected from different types of pumps that may be used interchangeably. Among these types of pumps are electric pumps and air pumps.

The mobile fluid dispenser may define a self-supporting upright position, with its wheels configured to fully support the mobile fluid dispenser so that the mobile fluid dispenser may be rolled on flat surfaces without being tipped from its upright position. In this respect, the mobile fluid dispenser may include four wheels, two of which are wheels mounted to the body with an axle and two of which are caster wheels.

DETAILED DESCRIPTION OF THE INVENTION

Figure 1:
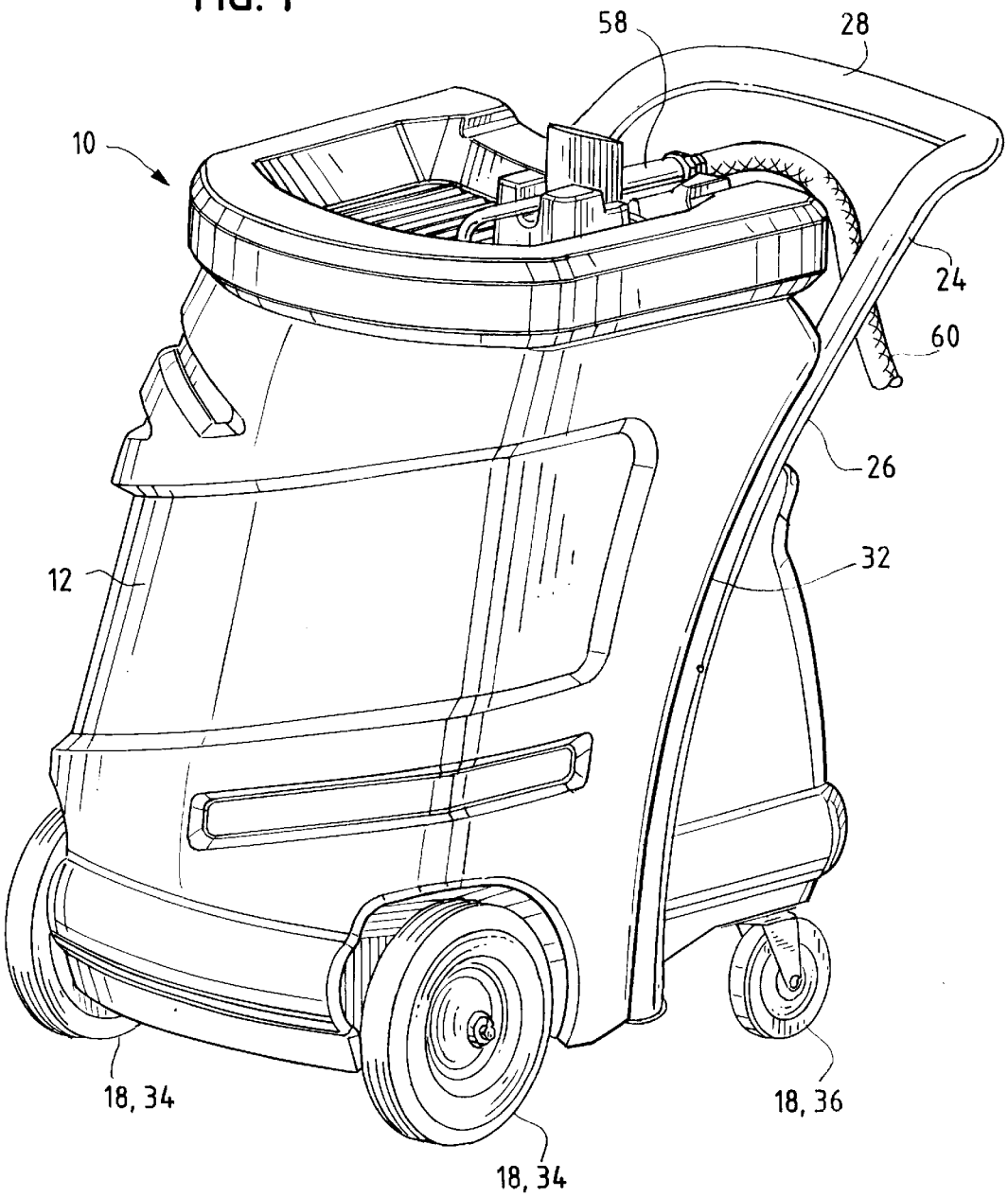
FIG. 1 is a perspective view of a mobile fluid dispenser formed in accordance with certain aspects of an embodiment of the present invention.

Referring to FIGS. 1 to 4, a mobile fluid dispenser 10 constructed in accordance with certain aspects of an embodiment of the present invention includes a body 12 defining a reservoir or tank 14 for containing a fluid, a pump 16 mounted on the body and being adapted to pump fluid from the reservoir, and a plurality of wheels 18 connected to the body such that the body can be rolled across a flat surface without tipping the body.

The body includes an upper portion 20 mounted to a base 22. The upper portion 20 may be formed from a molded polymeric material, such as polyethylene plastic, and the base 22 may be made of metal. Forming the base of metal adds to the structural rigidity and durability of the fluid dispenser. Alternatively, the upper portion 20 and base 22 could both be formed of a molded polymeric material, in which case they could be separately or integrally molded. When the upper portion and the base are formed separately, they are connected together to form an integral unit. For this purpose, fasteners (not shown), such as bolts or rivets, extend upwardly through the base and mate into reciprocal apertures formed in the bottom of the upper portion.

The mobile fluid dispenser 10 may also include at least one handle 24 for the user to grasp to move and maneuver the dispenser. In the illustrated embodiment, the handle extends from the rear of the dispenser. Alternatively, or additionally, a separate handle may also be provided on the front of the dispenser. The handle may be integrally formed with the body, e.g. by integrally molding it with the upper portion of the body. Alternatively, as is shown, the handle may be formed separately from the body. In the illustrated embodiment, the handle 24 consists of a pair of upstanding legs 26 and an upper cross member 28. The lower ends of the legs 26 mate with upstanding posts 30 formed on the base 22. Fasteners (not shown) extend through the legs and thread into the posts 30 to secure the legs 26 to the base 22. The legs 26 extend upwardly from opposite sides of the base and fit within the recesses 32 formed in the outside of the upper portion 20 of the body 12. The cross member 28 extends between the upper ends of the legs 26 and provides an area for the user to grasp.

The wheels 18 provide rolling contact with the surface that the mobile lubricant dispenser 10 is on, thereby providing for easy mobility of the mobile lubricant dispenser. In the illustrated embodiment, the dispenser includes four wheels. Two of the wheels are axle wheels 34 and two of the wheels are caster wheels 36. The axle wheels rotate about an axle 38 that is mounted to the base 22. The caster wheels are connected to the base such that they rotate about a first, generally horizontal, axis and they pivot about a second, generally vertical, axis that is perpendicular to the first axis. Because the caster wheels 36 pivot, the mobile lubricant dispenser 10 is easier to steer and has greater maneuverability. The axle wheels 34 may, for example, be 12-inch semi-pneumatic wheels located proximal to the front of the mobile lubricant dispenser 10. Whereas, the caster wheels 36 may, for example, be 6 inch casters with parking brakes, and they may be located proximal to the back of the dispenser 10.

The mobile lubricant dispenser 10 stands on its own without external support when in its upright position, and is fully supported by its wheels 18 without the aid of skids or other body surfaces. In other words, the mobile lubricant dispenser 10 is self-supporting in its upright position. Because the mobile lubricant dispenser 10 is fully supported by the wheels 18, the dispenser may be moved about the shop floor in its upright position, and an operator does not have to tip the dispenser 10 from its upright position to move it. The ability to move the dispenser 10 in its stable upright position without tipping is especially advantageous when the dispenser has a relatively large fluid capacity, e.g., a working range of 55 gallons.

Figure 2:
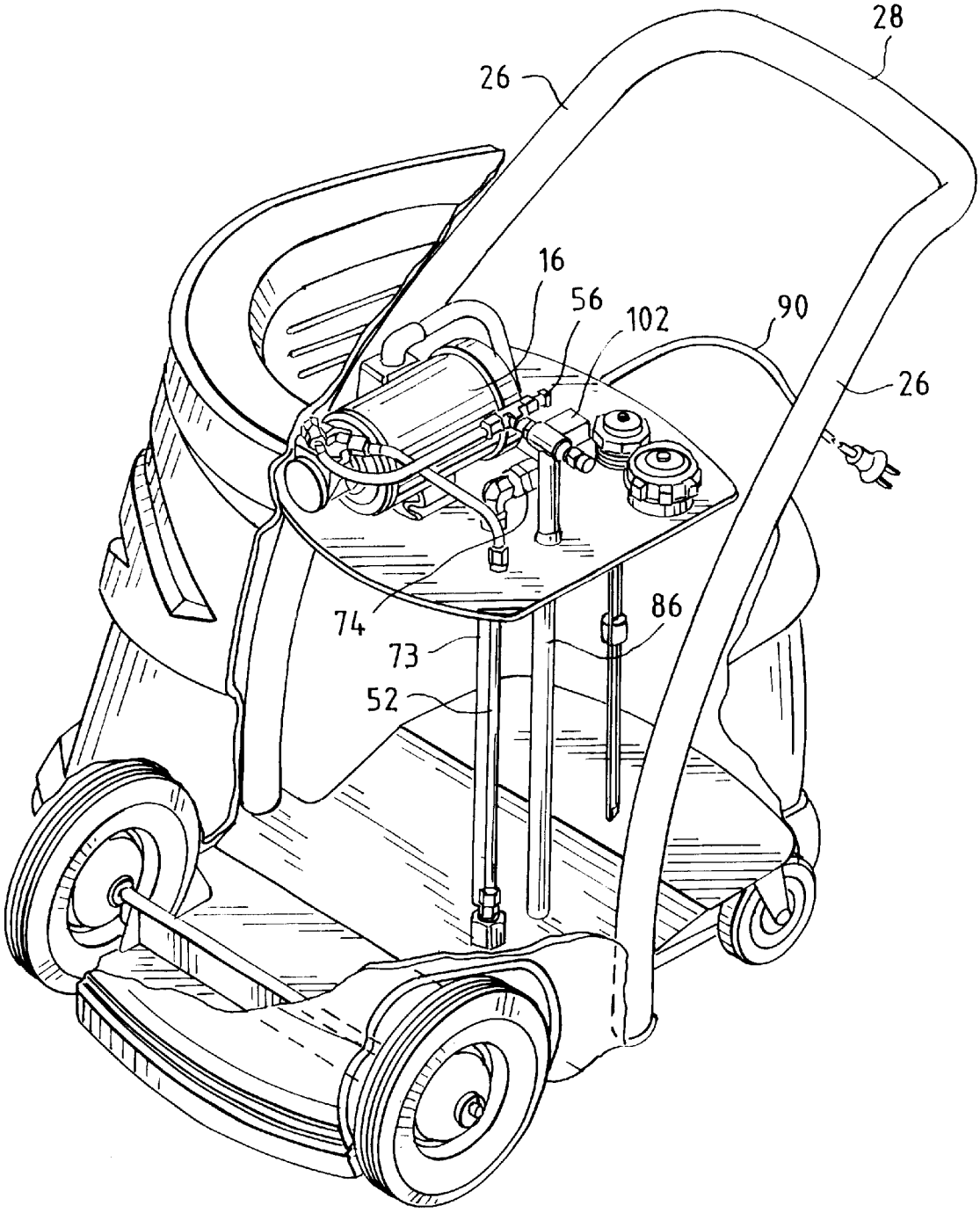
FIG. 2 is a cut-away view further illustrating certain aspects of the mobile fluid dispenser of FIG. 1.
Figure 3:
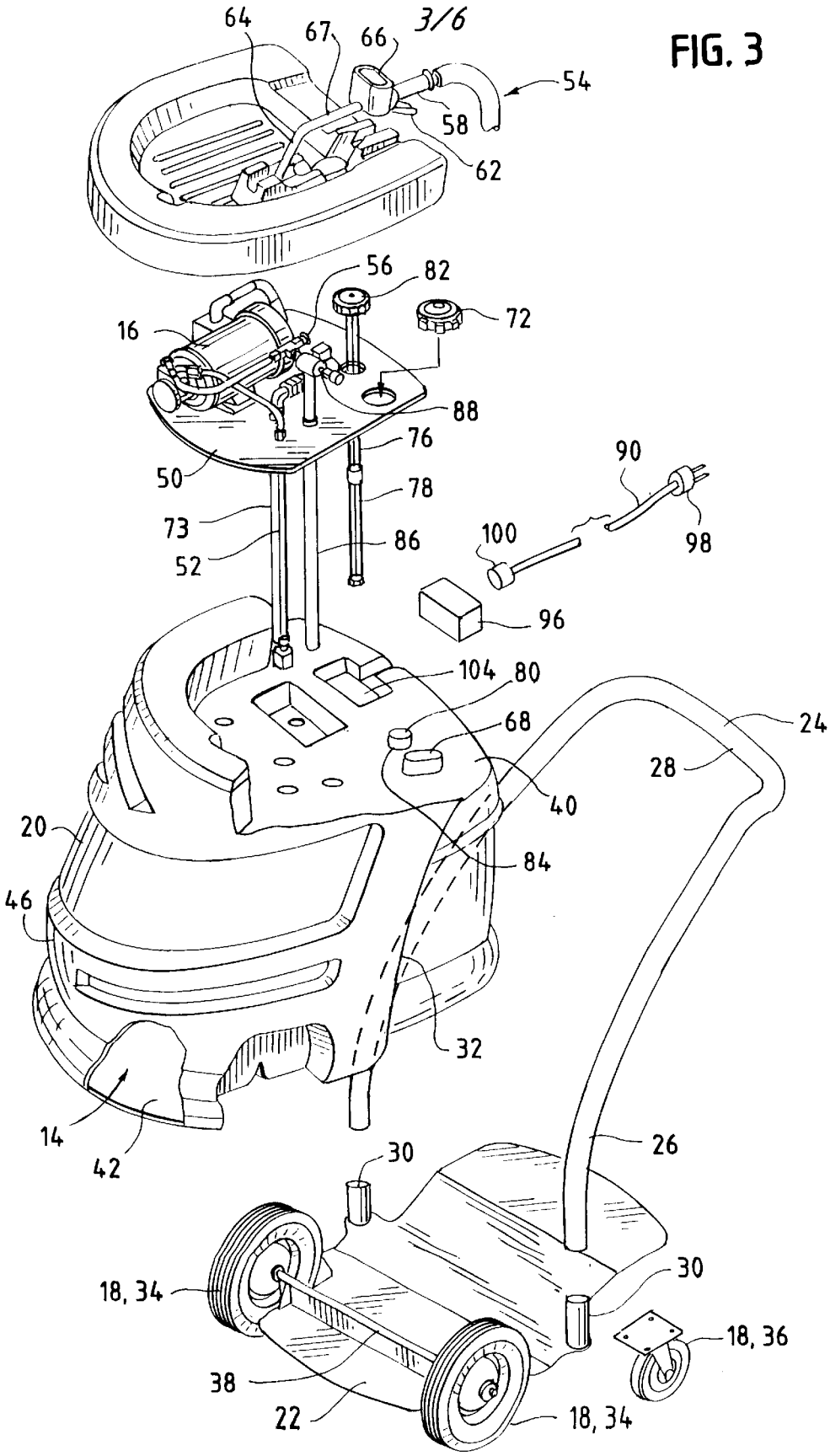
FIG. 3 is an exploded perspective view of the fluid dispenser of FIG. 1.

As shown in FIGS. 2 and 3, the upper portion 20 includes the fluid tank 14. According to one embodiment, the tank has a reservoir capacity of 63 gallons, with a 55 gallon working range. The tank 14 is designed to prevent spillage, leakage, or contamination of the lubricant, and to be capable of being filled and re-filled without removal from the upper portion from the base 22.

In this respect, the tank 14 is defined by a top wall 40, a bottom wall 42 and a side wall 46 extending between the top and bottom walls. The top wall 40 defines an area for mounting the pump 16 to the body 12. A metal reinforcing plate 50 may be interposed between the top wall 40 and the pump 16 to provide a rigid surface on which to mount the pump. The reinforcing plate 50 may be secured to the top wall 40 by fasteners (not shown) which extend through the plate 16 and thread into reciprocal apertures in the top wall.

The pump 16 is mounted on the reinforcing plate 50 and is adapted to pump fluid from the tank 14. The pump may be an electric pump, such as a model 1LE-A Gear Pump as is available from Tuthill Pump Group, 12500 South Pulaski Road, Alsip, Ill. 60803. The model 1LE-A pump is an electric motor and gear pump capable of delivering oil at over 2 gallons per minute. The model 1LE-A pump is self priming, is equipped with a suction check valve to eliminate entrained air in the dispensed oil, and has an external bypass pressure relief circuit.

A pumping line 52 extends between an inlet of the pump and the tank to provide a path for fluid to flow from the tank to the pump. A fluid delivery system 54 is connected to the outlet of the pump via a coupler, such as a dry-break quick-connect connected to an outlet 56 of the pump for dispensing fluid output by the pump. The fluid delivery system 54 includes fluid dispensing wand 58 interconnected with the outlet of the pump via a hose. The fluid dispensing wand may be a model 3330-037 or 3331-008 as is available from Balcrank Products Inc., 115 Reems Creek Road, Weaverville, N.C. 28787. The wand 58 includes a lever or trigger 62 connected to an internal valve for controlling fluid flow through the nozzle 64 of the wand. The wand 58 also includes a digital meter 66 for measuring fluid flow through the nozzle so an operator can monitor the amount of fluid being dispensed. Preferably, the digital meter 66 displays in quarts to the nearest 1/10 quart. The nozzle 64 is configured to extend into a receptacle, such as an oil fill opening in an engine, thereby minimizing spillage during lubricant delivery.

Lubricant is added to the tank 14 through the fill opening 68 formed in the top wall 40. When lubricant is not being added, a fill cap 72 is secured in place over the fill opening to prevent spillage or contamination. Preferably, the fill opening is about 3 inches in diameter to allow direct refilling from an oil supply truck. An annular wall 69 extends around the fill opening 68. The exterior of the wall 69 is threaded so the cap 72, can be screwed onto the wall 69 to cover the opening. Alternatively, fluid may be added to the tank 14 via a fill line 73. The fill line 73 includes a dry-break quick-connect coupler 74 that can be connected to a hose to permit fluid to be pumped into the tank from a refill pump system (not shown). The mobile lubricant dispenser further includes a level gauge. In the illustrated embodiment, the level gauge is a floating depth gauge with an indicator, such as those that are commonly used on recreational vehicles such as snowmobiles. The float portion 78 of the level gauge 76 extends through an opening 80 in the top wall 40. The cap 82 of the gauge 76 threads onto an annular wall 84 which is formed around the opening 80.

According to one embodiment of the present invention, the overall dimensions of the mobile lubricant dispenser are about 46" high by about 50" long by about 29" wide, with a weight of about 125 pounds empty and about 540 pounds full. Preferably, the body and tool tray are made of impact grade cross-linked polyethylene plastic molded to a thickness of more than about ¼". Steel reinforcing plates may also be used near the base and top wall.

The pump assembly further includes a return line 86 interconnected with the pump 16 by a relief valve 88. The relief valve 88 is also connected between the pump 16 and the outlet 56. Lubricant drawn to the pump from the tank via the pumping line 52 is, in the absence of use of the trigger, returned to the tank via the return line 86. When the trigger 62 is depressed, the lubricant is dispensed via the nozzle 64 instead of being returned to the tank.

A power cord 90 is interconnected with the pump 16 for delivering electricity thereto. The means may include a power cord having a first end interconnected with the pump for delivering electricity thereto and a second end terminating in a conventional male electrical plug. The cord may, for example, be 30 feet long, and may be carried by a cord reel so that it can be retracted when not in use. A power cord 90 is interconnected with the pump 16 for delivering electricity to the pump from a remote source, e.g. an outlet. The power cord 90 has a first end interconnected with the pump through a junction box 96 and a second end which terminates in a male electrical plug 98 configured for insertion into an outlet. The first end of the power cord may include a connector 100 configured to mate with a reciprocal connector (not shown) carried by the junction box 96, to permit the cord 90 to be disconnected from the junction box. A switch 102 is interconnected between the power cord 90 and the pump 16 for controlling operation of the pump. The interconnection between the pump 16, the switch 102 and the power cord 90 is contained within the junction box 96. The junction box 96 is configured to fit within a recessed pocket 104 defined by the top wall 40. The junction box includes a top wall which carries the switch 102. The top wall of the junction box may be defined by a portion of the metal reinforcing plate 50, as shown, or it may be formed from a separate plate configured to mate with the top of the junction box. The junction box may be configured to house a cord reel to permit the cord reel to be retracted when not in use. It will be appreciated that in such a design, the cord would not be disconnectable from the junction box, as shown.

Figure 4:
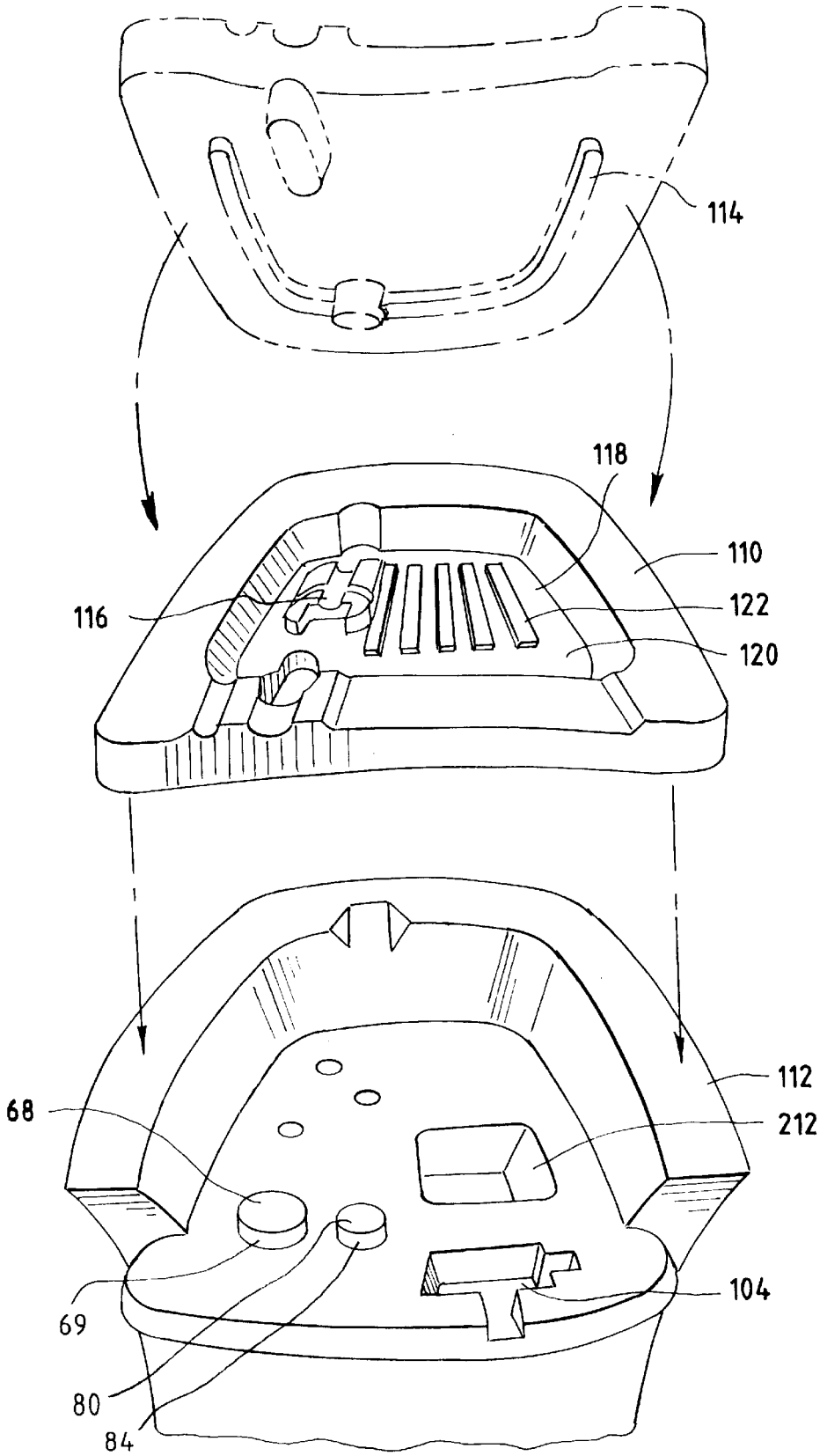
FIG. 4 is a rear partial perspective view showing the pump mounting area and the removable tool tray of the mobile fluid dispenser of FIG. 1.

A removable tool tray 110 is provided for storing the wand 58 when it is not being used. The tool tray 110 is constructed to mate with and be supported by an upstanding wall 112 formed around the perimeter of the top wall 40 of the upper portion 20. In the illustrated embodiment, the upstanding wall 112 only extends around the front and sides of the top wall 40. As can be seen in FIG. 4, the back is left open. The back opening provides space for the hose 60 to extend between the tool tray 110 and the top wall and also allows the operator to read the level gage 76 and operate the switch 102 without removing the tool tray.

As can be seen in FIG. 4, the tool tray 110 includes a downwardly extending flange 114 sized to fit within the perimeter of the upstanding wall 112. The top face of the tray includes a rest or bracket 116 for receiving and supporting the wand 58. The wand rest 116 is formed by raised surfaces and/or depressions configured to accept the wand. The tool tray also defines a basin or reservoir 118 that collects any drainage or dripping from the wand 58 when it is being stored on the tool tray. This drainage can be removed by removing and cleaning the tool tray 110. The tool tray 110 can also be removed to provide access to the pump and the fill opening. The tool tray includes an area for storing other tools and rags, for example. In this respect the tool tray includes a base 120 and a plurality of ridges 122 that extend upwardly from the base. When shop tools rest on the ridges 122, particles and/or oil can drain into the base. Any accumulated drainage can be removed by removing and cleaning the tool tray 110.

The body 12 may also include a hose pocket 124 for storing the hose when lubricant is not being dispensed. The hose pocket 124, shown in broken lines in FIG. 6, may be molded integrally with the upper portion of the body.

The procedure to fill and dispense lubricant from an embodiment of the mobile lubricant dispenser with an electric pump is as follows. First, the mobile lubricant dispenser 10 is brought to an external fluid source (not shown) for filling. The tool tray 110 is removed to provide access to the fill opening 68. The fill cap 72 is then removed, and fluid is added to the tank through the fill opening, e.g. from an oil supply truck. Alternatively, fluid may be pumped into the tank 14 via the refill line 73. Once the desired amount of fluid has been added, the fill cap is placed back into position, covering the fill opening. Once filled and with the fill cap back in place, the tool tray may be replaced, and the mobile lubricant dispenser 10 may be positioned near the desired lubricant delivery site (for example, a car).

Once the mobile lubricant dispenser is close to the desired lubricant delivery site, the power cord may be extended and connected to an outlet. The wand 58 is then removed from the tool tray 110 and positioned for lubricant delivery. The trigger 62 is depressed to initiate lubricant flow from dispenser. After the desired amount of lubricant has been dispensed, the trigger 62 is released, stopping the lubricant flow from the fluid delivery system. The wand 58 is then returned to the tool tray, and the mobile lubricant dispenser may be moved to the next desired lubricant delivery site.

Figure 5:
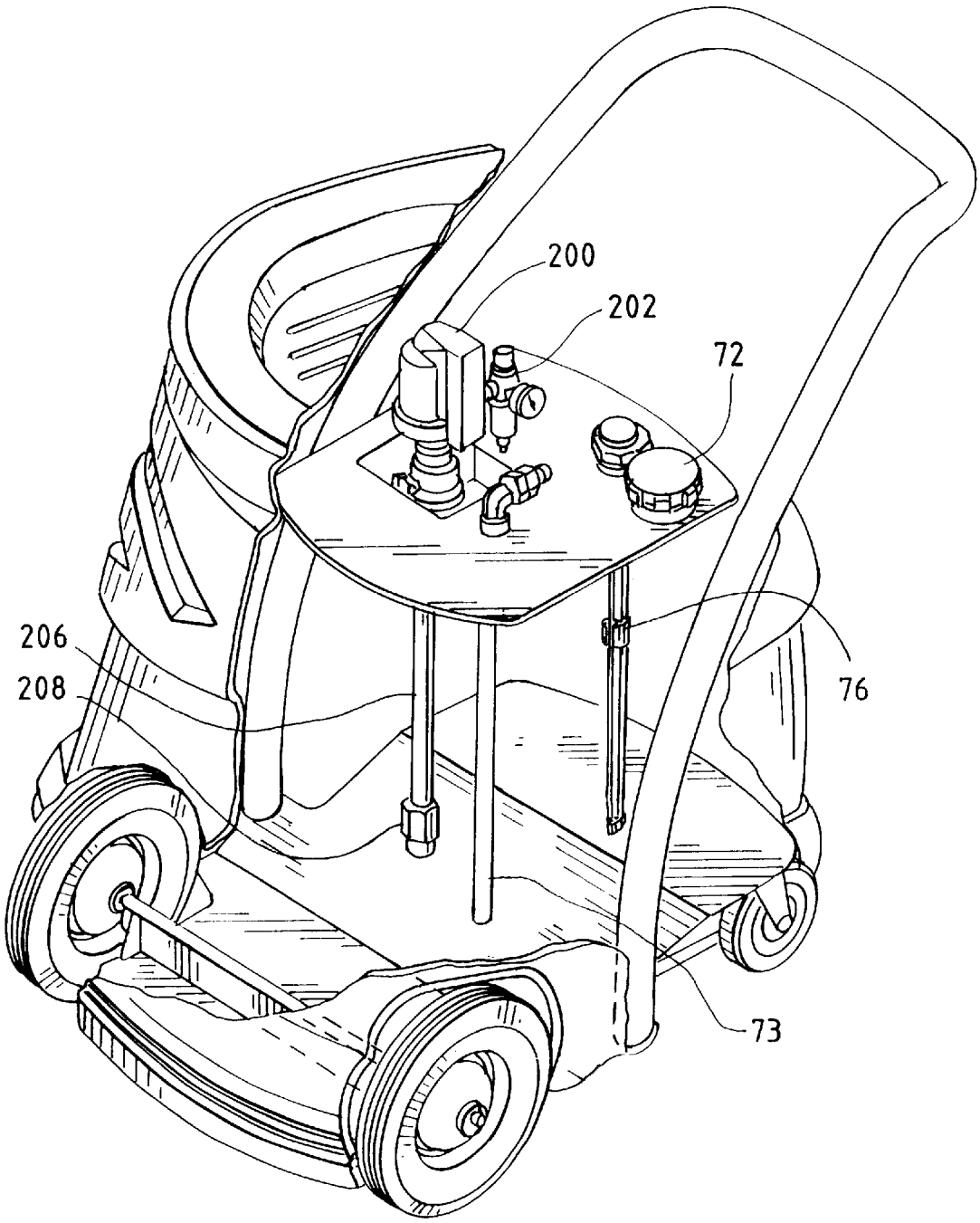
FIG. 5 is a cut-away perspective view illustrating an alternative embodiment of the present invention.
Figure 6:
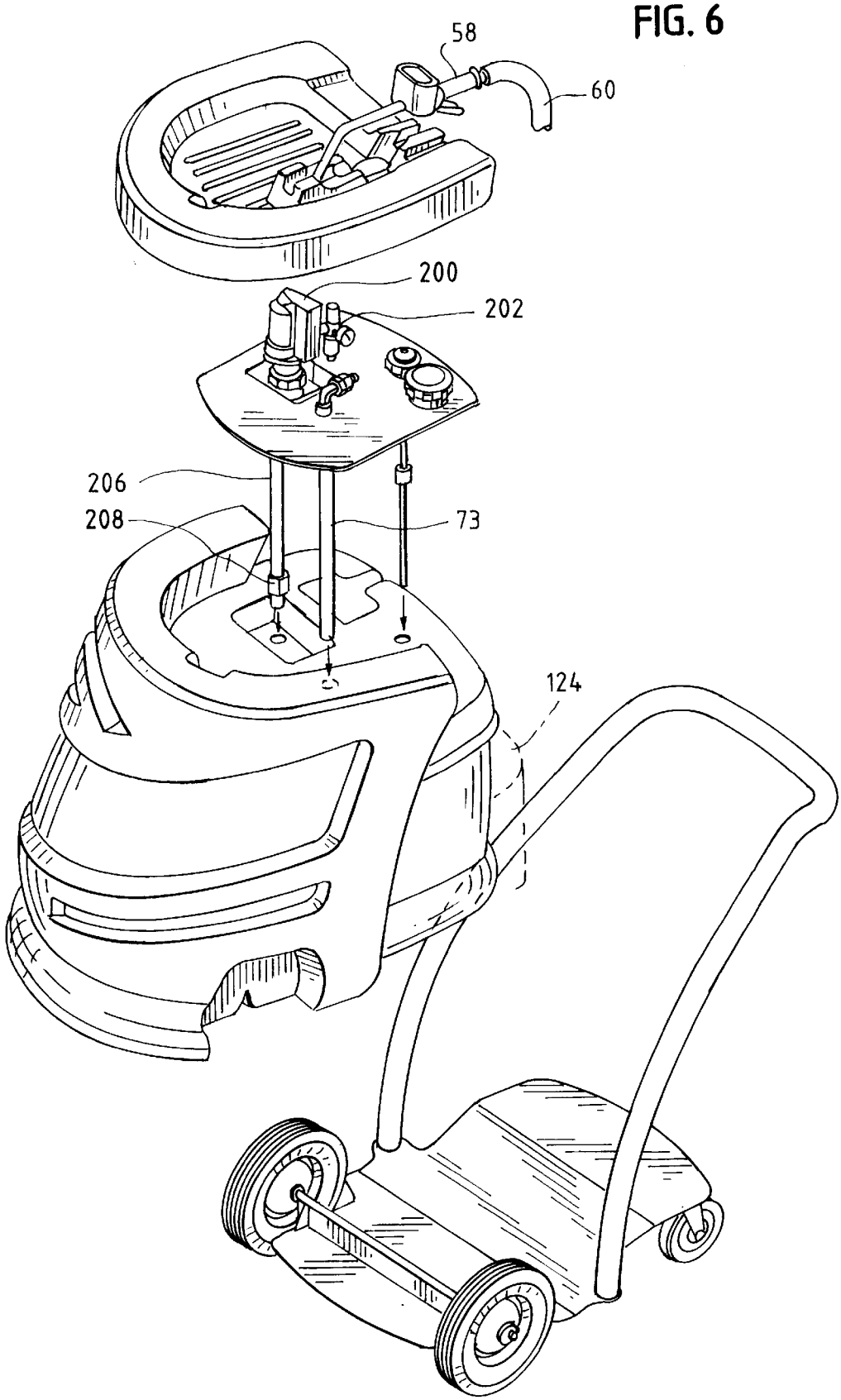
FIG. 6 is an exploded view of the embodiment of FIG. 5.

FIGS. 5 and 6 illustrate a second embodiment of the mobile fluid dispenser. The structure of the second embodiment is generally the same as the first embodiment, except that it employs an air operated, e.g. pneumatic, pump 200 instead of an electrically powered pump. The air pump may, for example, be a 5:1 ratio air-operated stub pump that can deliver oil at over 2 gallons per minute at air pressures between about 60 to 100 psi. A suitable pump is a model T512 Oilmaster as is available from Macnaught Pty. Ltd., A.C.N. 000 075 785, 41-49 Henderson Street, Turella, Sydney, NSW Australia 2205.

The air pump 200 is connected to an external source of compressed air via a pressure regulator 202. The regulator includes a dial operated valve for regulating the air pressure supplied to the pump, thereby controlling the speed of the pump. The regulator may also include an air filter for removing impurities from the supply of pressurized air. The pressure regulator may also include a conventional quick connect coupler (not shown) configured for interconnection with a reciprocal connector carried by an air hose, not shown, for delivering compressed air to the pump. When operating, the pump 200 draws fluid up through a suction tube 206 and delivers it to the hose 60 via an outlet (not shown). The outlet of the pump may include a conventional dry-break quick-connector coupling configured for interconnection with the hose 60. The suction line 206 includes a foot check valve 208 to eliminate entrained air in the dispensed oil. A similar check valve maybe provided on the pumping line 52 of the first embodiment.

The fluid tank 14 may be filled via the fill opening 68 or the fill line 73, in the same manner as described above in connection with the first embodiment. Alternatively, or in addition, the pump may be a reversible pump so that the pump can be used to fill the tank 14 with fluid from an external source. In such an instance, the tank would be filled by disconnecting the hose 60 from the pump. A hose would then be interconnected between the pump and an external fluid supply. The pump would then be operated in reverse to pump fluid from the supply source and into the dispenser's tank 14.

Preferably, the mobile lubricant dispenser has the capability of using different types of pumps interchangeably. For example, the pump mounting area could be configured to accept either an air pump or an electric pump. This could be accomplished by using an air pump and an electric pump with identical mounting dimensions.

Alternatively, the top wall 40 may be configured to accept pumps having different mounting dimensions, such as the electric pump 16 and the air pump 200. In particular, as is shown in FIG. 4, the top wall may include both the pocket 104 for the junction box and a pocket 212 configured to accept air pump 200. In such a design, mounting differences between the pumps can be accommodated by providing different reinforcing plates 50. For example the reinforcing plate for the air pump 200 would include an opening which aligns with the pocket 212, but it would not include an opening for the switch 102. Openings for the supply and return lines could be drilled into the top wall 40 at the locations required for the particular pump being used.

Although the present invention has been described with reference to specific details of certain embodiments thereof, it is not intended that such details should be regarded as limitations upon the scope of the invention except insofar as they are included in the accompanying claims.

What is claimed is:

1. A mobile fluid dispenser, comprising:

a body defining a reservoir for containing a fluid wherein said body comprises an upper portion and a base;

a pump mounted on the upper portion of the body and being adapted to pump fluid from the reservoir;

a plurality of wheels connected to the body such that the body can be rolled across a flat surface without tipping the body;

a hose having a first end connected to the pump for receiving fluid output by the pump and a second end connected to a nozzle which is adapted to meter fluid flow through the hose; and a tool tray adapted to receive and support the nozzle.

2. A mobile fluid dispenser as set forth in claim 1, wherein the upper portion defines the fluid reservoir; and the base is connected to and supports the upper portion and is connected to the wheels.

3. A mobile fluid dispenser as set forth in claim 2, wherein the upper portion is formed from a polymeric material.

4. The mobile fluid dispenser of claim 2 wherein the base is formed at least in part of metal.

5. A mobile fluid dispenser as set forth in claim 1, wherein the pump comprises an electrically powered pump and the fluid dispenser further comprises means for delivering electricity to said pump.

6. A mobile fluid dispenser as set forth in claim 5, wherein said means for delivering electricity comprise a cord reel mounted on the body, the cord reel including a power cord adapted to delivery having a first end interconnected with the pump for delivering electricity thereto and a second end interconnected with an electric plug configured for interconnection with an external source of electric power, the power cord being extendable onto the cord reel when not m use and being extendable from the cord reel for interconnection with an external source of electric power.

7. A mobile fluid dispenser as set forth in claim 1, wherein the pump comprises a pneumatically powered pump.

8. A mobile fluid dispenser as set forth in claim 1, wherein said plurality of wheels comprises at least three wheels.

9. A mobile fluid dispenser as set forth in claim 8, wherein said plurality of wheels comprise a pair of wheels mounted to the body with an axle and at least one caster wheel.

10. A mobile fluid dispenser as set forth in claim 1, wherein said reservoir further comprises a top wall defining a fluid fill opening configured to allow the reservoir to be filled with fluid from a remote source; and a cap removably mountable over said fluid fill opening.

11. A mobile fluid dispenser as set forth in claim 1, wherein said pump is a reversible pump and is further adapted to pump fluid into said reservoir from a remote source.

12. A mobile fluid dispenser as set forth in claim 1, wherein the body further includes a pump mounting surface which is configured to receive a variety of different pumps.

13. The mobile fluid dispenser of claim 1, wherein said mobile fluid dispenser farther comprises a pump mounting area, said pump mounting area configured so that said pump is selected from at least two types of pumps, whereby said mobile fluid dispenser can use said types of pumps interchangeably.

14. The mobile fluid dispenser of claim 13, wherein said types of pumps comprises air pumps and electric pumps.

15. A mobile fluid dispenser, comprising:

a body comprising an upper portion formed of a polymeric material and a base permanently connected to and adapted to support the upper portion, the upper portion defining a reservoir;

a pump mounted on the upper portion of the body and being adapted to pump fluid from the reservoir, a plurality of wheels connected to the base of the body in a manner such that the body can be rolled across a flat surface without tipping the body, wherein two wheels are axel wheels located proximal to the front of the dispenser and at last one wheel is a castor wheel located proximal to the back of the dispenser;

a hose having a first end connected to the pump for receiving fluid output by the pump and a second end;

a fluid dispensing wand connected to the second end of the hose and being adapted to meter fluid flow from the pump and through the hose; and a tool tray removably connectable to the body portion at a position that overlies the reservoir.

16. The mobile fluid dispenser of claim 15, wherein the base is formed at least in part from metal.

17. A mobile fluid dispenser comprising:

a body defining a reservoir for containing a fluid;

a pump mounted on the body and being adapted to pump fluid from the reservoir;

a plurality of wheels connected to the body such that the body can be rolled across a flat surface without tipping the body;

a hose having a first end connected to the pump for receiving fluid output by the pump and a second end connected to a nozzle which is adapted to meter fluid flow through the hose; and a tool tray adapted to receive and support the nozzle wherein the tool tray overlies the reservoir and is removably connected to the body to provide access to the reservoir.

18. A mobile fluid dispenser comprising:

a body defining a reservoir for containing a fluid;

a pump mounted on the body and being adapted to pump fluid from the reservoir;

a plurality of wheels connected to the body such that the body can be rolled across a flat surface without tipping the body;

a hose having a first end connected to the pump for receiving fluid output by the pump and a second end connected to a nozzle which is adapted to meter fluid flow through the hose; and a tool tray adapted to receive and support the nozzle wherein the tool tray includes a catch basin adapted to catch and retain fluid which leaks from the nozzle when the nozzle is positioned on the tool tray.

19. A mobile fluid dispenser comprising a body comprising an upper portion formed of a polymeric material and a base permanently connected to and adapted to support the upper portion, the upper portion defining a reservoir;

a pump mounted on the body and being adapted to pump fluid from the reservoir;

a plurality of wheels connected to the base of the body in a manner such that the body can be rolled across a flat surface without tipping the body;

a hose having a first end connected to the pump for receiving fluid output by the pump and a second end;

a fluid dispensing wand connected to the second end of the hose and being adapted to meter fluid flow from the pump and through the hose and through the nozzle of the wand; and a tool tray removably connectable to the body portion at a position that overlies the reservoir wherein the tool tray is configured to receive and support the fluid dispensing wand when the fluid dispensing wand is not in use and wherein the tool tray defines a catch basin for catching fluid that leaks from the nozzle when it is positioned on the tray.

* * * * *